US007001313B1

(12) United States Patent
Crnkovich

(10) Patent No.: US 7,001,313 B1
(45) Date of Patent: Feb. 21, 2006

(54) EXERCISE ASSISTANCE DEVICE

(76) Inventor: Gary M. Crnkovich, 26092 Avenida Calidad, Mission Viejo, CA (US) 92691

( * ) Notice: Subject to any disclaimer, the term of this patent is extended or adjusted under 35 U.S.C. 154(b) by 377 days.

(21) Appl. No.: 10/444,254

(22) Filed: May 23, 2003

(51) Int. Cl.
*A63B 22/00* (2006.01)
*A61H 3/04* (2006.01)

(52) U.S. Cl. ..... 482/68; 482/74; 135/67; 280/87.021

(58) Field of Classification Search ..... 482/51, 482/66–69, 74, 78, 79, 143; 280/87.051, 280/87.05, 87.021, 87.041; 472/15; 135/67, 135/65; D12/130
See application file for complete search history.

(56) References Cited

U.S. PATENT DOCUMENTS

| | | | | | |
|---|---|---|---|---|---|
| 2,843,180 | A | | 7/1958 | Schwartz | |
| 3,529,700 | A | | 9/1970 | Marshall | |
| 4,029,311 | A | | 6/1977 | Chanslor et al. | |
| 4,312,505 | A | | 1/1982 | Engelhart | |
| 4,341,381 | A | * | 7/1982 | Norberg | 482/67 |
| D277,561 | S | * | 2/1985 | Erfurth | D12/130 |
| 4,510,956 | A | | 4/1985 | King | |
| 4,557,257 | A | | 12/1985 | Fernandez et al. | |
| D293,663 | S | * | 1/1988 | Erfurth | D12/130 |
| 4,813,664 | A | * | 3/1989 | Vroulis | 482/68 |
| 4,907,794 | A | | 3/1990 | Rose | |
| 5,046,748 | A | | 9/1991 | Oat-Judge | |
| 5,112,044 | A | | 5/1992 | Dubats | |
| 5,378,215 | A | * | 1/1995 | Harkins | 482/67 |
| 5,409,028 | A | | 4/1995 | Lee | |
| 5,451,193 | A | * | 9/1995 | Pickard | 482/68 |
| 5,676,388 | A | * | 10/1997 | Bertani | 280/87.041 |
| D396,437 | S | | 7/1998 | Liljedahl | |
| 5,839,740 | A | * | 11/1998 | Seeger | 280/87.021 |
| 6,039,333 | A | | 3/2000 | Hamblin | |
| 6,079,725 | A | | 6/2000 | Lazaros | |
| 6,110,076 | A | | 8/2000 | Hurt | |
| D451,053 | S | | 11/2001 | Hallgrimsson | |
| 6,338,355 | B1 | | 1/2002 | Cheng | |
| 2001/0048206 | A1 | * | 12/2001 | Niu et al. | 280/87.021 |
| 2003/0228959 | A1 | * | 12/2003 | Perlstein | 482/74 |
| 2004/0079405 | A1 | * | 4/2004 | Sanders et al. | 135/67 |

* cited by examiner

*Primary Examiner*—Gregory L. Huson
*Assistant Examiner*—Victor K. Hwang
(74) *Attorney, Agent, or Firm*—James G. O'Neill, Klein, O'Neill & Singh, LLP

(57) ABSTRACT

A recreational assistance device having a streamline shaped substantially open main body with four large pneumatic tires to allow the device to move easily over rough terrain. The device is equipped with a braking system including at least one brake handle. A safety harness may be secured to the braking system and worn by a user to automatically actuate the braking system if the person falls, slips or stumbles when jogging or walking. The handle bars and other upper portions of the device are preferably padded and the rear wheels have associated movable stops to allow the device to be stopped and held in a rest or stop position. The four-wheel recreational assistance device may be provided with telescoping supporting arms for a carrying bag for holding packages or other materials.

16 Claims, 3 Drawing Sheets

EXERCISE ASSISTANCE DEVICE

BACKGROUND OF THE INVENTION

1. Field of the Invention

This invention relates generally to four-wheeled vehicles, and more particularly, to an improved four-wheeled recreational assistance device to aid mature adults and others in maintaining an active and more fit life, while providing them with increased balance and security from falling during exercise.

2. Description of Related Art

Jogging strollers to safely hold a baby or child while a parent pushes the stroller from behind during jogging are known. In addition, many types of walkers or wheeled rollators for use by a person with disabilities or age related problems are known to aid such person's in safely moving about.

Examples of known prior art devices are disclosed in the following listed U.S. patents and published patent application:

Des. 396,437 to Liljedahl; Des. 451,052 to Hallgimsson; U.S. Pat. No. 2,843,180 to Schwartz; U.S. Pat. No. 3,529,700 to Marshall; U.S. Pat. No. 4,029,311 to Chanslor et al; U.S. Pat. No. 4,312,505 to Engelhart; U.S. Pat. No. 4,510,956 to King; U.S. Pat. No. 4,557,257 to Fernandez et al; U.S. Pat. No. 4,907,794 to Rose; U.S. Pat. No. 5,046,748 to Oat-Judge; U.S. Pat. No. 5,112,044 to Dubats; U.S. Pat. No. 5,409,028 to Lee; U.S. Pat. No. 6,039,333 to Hamblin; U.S. Pat. No. 6,079,725 to Lazaros; U.S. Pat. No. 6,110,076 to Hurt; U.S. Pat. No. 6,338,355 to Cheng; and 2001/0048206 to Niu et al.

Although the known prior art devices or vehicles are useful for pushing a baby from behind while jogging, or aiding a disabled or infirmed person while moving, they fail to adequately accommodate persons, such as mature adults, during exercise walking or jogging when they are alone and who might need some, but limited aid in maintaining their balance and security during such exercise.

As the benefits of exercise become more widely understood, more and more persons with mobility and/or balance problems, such as mature or older persons, feel the need to increase their exercise time to enjoy the benefits of keeping fit and healthy. Among other things, such persons wish to be outdoors where they may jog, walk or otherwise move around. However, such persons sometimes tire easily and quickly, or have trouble with their feet and/or balance when jogging or walking long distances, or when they are moving quickly or over rough terrain. Additionally, current walkers are not durable or mobile enough for their end use.

There exists, therefore, a need in the art for a recreational assistance device for persons, such as mature adults and others, that is affordable and easy to use, without requiring the assistance of others, when jogging, shopping or walking at speed, or for long distances over all types of terrain.

SUMMARY OF THE INVENTION

It is a general object of the present invention to provide an improved assistance device. It is a more particular object of the present invention to provide an improved recreational assistance device that may be used by persons with mobility problems to more easily exercise, jog, go shopping, or walk at speed or for long distances. It is another more particular object of the present invention to provide an improved four-wheeled recreational assistance device that may support mature adults in a safe and secure manner. It is yet a still more particular object of the present invention to provide an improved recreational assistance device having four wheels, a braking system and back stops for stopping the device and preventing unwanted movement. It is yet a further particular object of the present invention to provide an improved four-wheeled recreational assistance device having padded upper portions and a safety harness that will operate the braking system if a person using the device falls, slips or stumbles while jogging or walking. And, it is a further particular object of the present invention to provide an improved streamlined, sturdy four-wheel recreational assistance device that does not look like a medical device, and which may include retractable arms for supporting a carrying bag to aid a person in shopping and carrying bulky items while jogging or walking over substantially any type of terrain.

In accordance with one aspect of the present invention, there is provided an improved recreational assistance device having a streamline shaped main body with four large pneumatic tires to allow the device to move easily over rough terrain. The device is equipped with a braking system including at least one brake handle. A safety harness may be secured to the device and worn by a user to automatically actuate the braking system if the person falls, slips or stumbles when jogging or walking. The handle bars and other upper portions of the device are preferably padded and the rear wheels have associated movable stops to allow the device to be stopped and held in a rest or stop position. The four-wheel recreational assistance device may be provided with retractable arms for a carrying bag for holding packages or other materials.

BRIEF DESCRIPTION OF THE DRAWINGS

The objects and features of the present invention, which are believed to be novel, are set forth with particularity in the appended claims. The present invention, both as to its organization and manner of operation, together with further objectives and advantages, may best be understood by reference to the following description, taken in connection with the accompanying drawings, in which:

DESCRIPTION OF THE PREFERRED EMBODIMENTS

Figure 1:
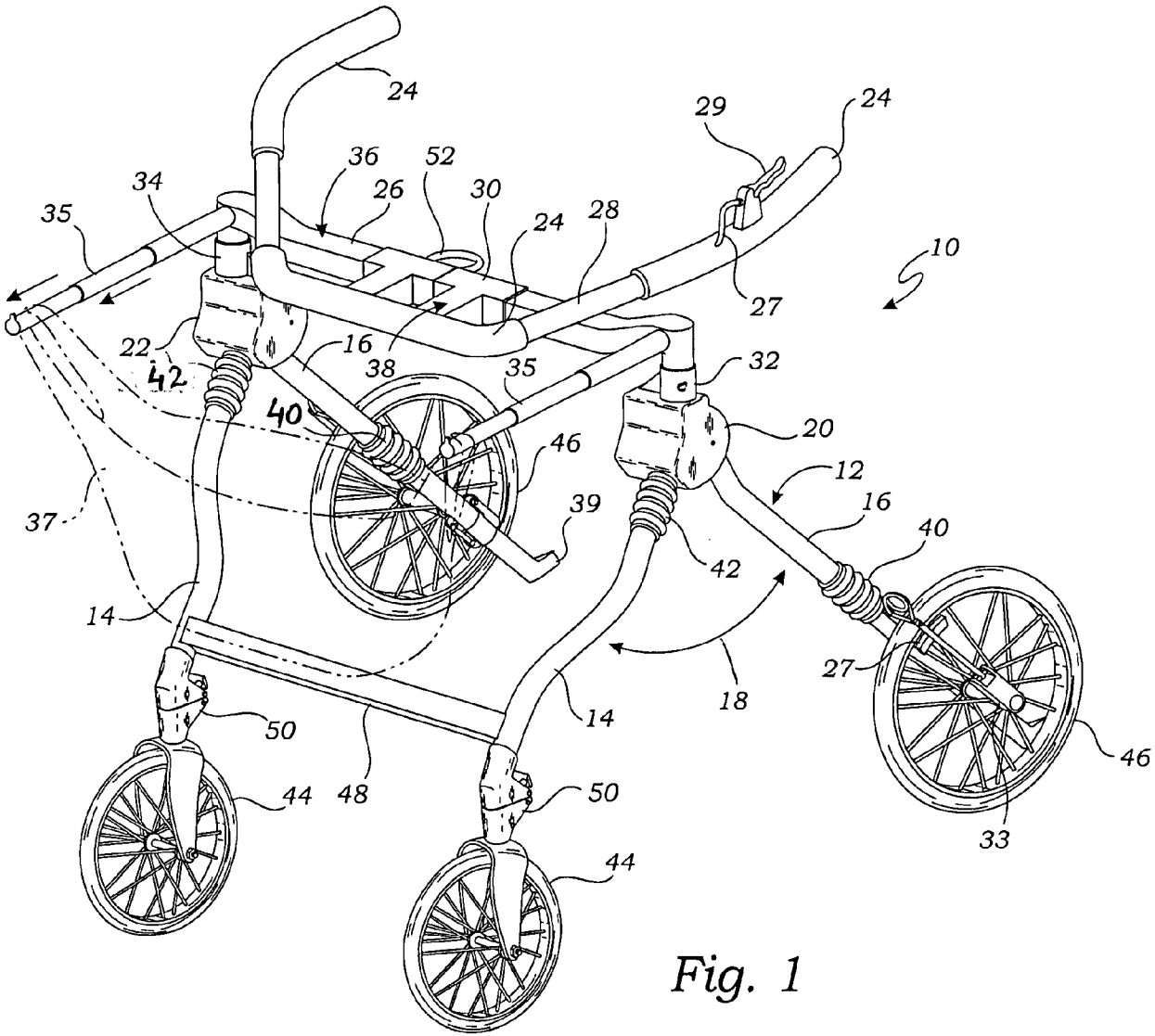
FIG. 1 is a perspective view of an improved four-wheeled recreational assistance device of the present invention.
Figure 2:
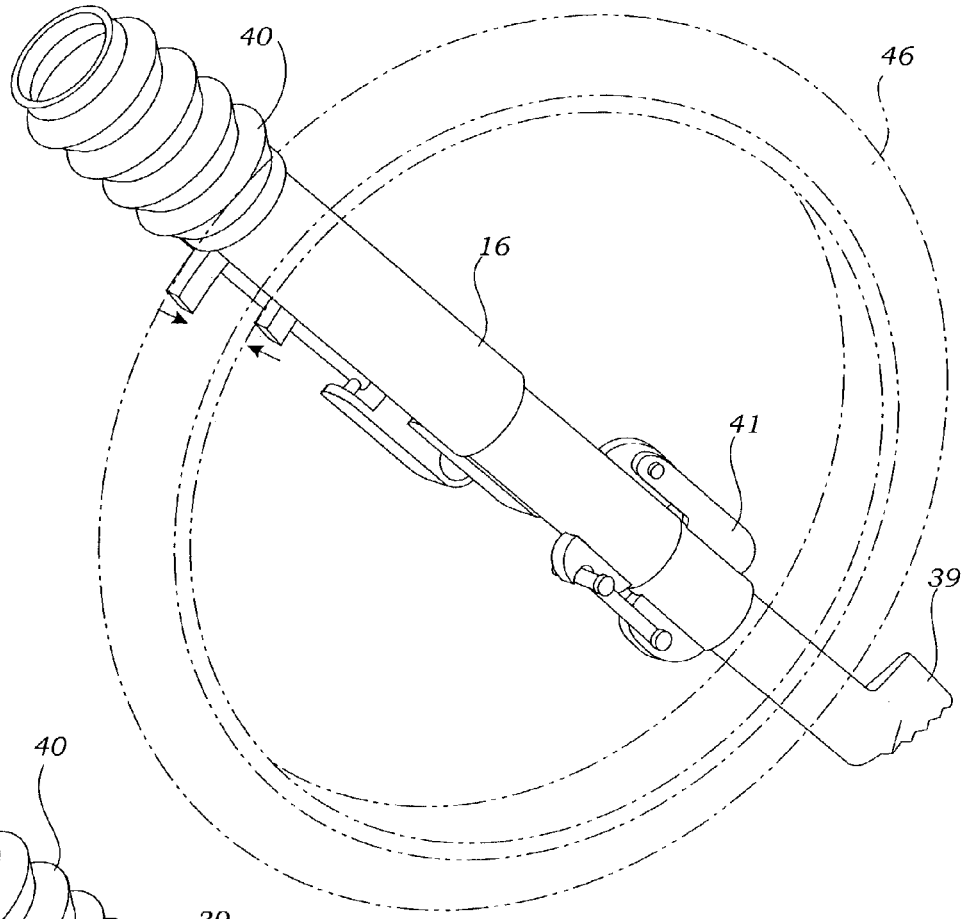
FIG. 2 is an enlarged partial perspective view of a rear safety stop of the four-wheeled recreational assistance device of FIG. 1, in the lowered or operating position.
Figure 3:
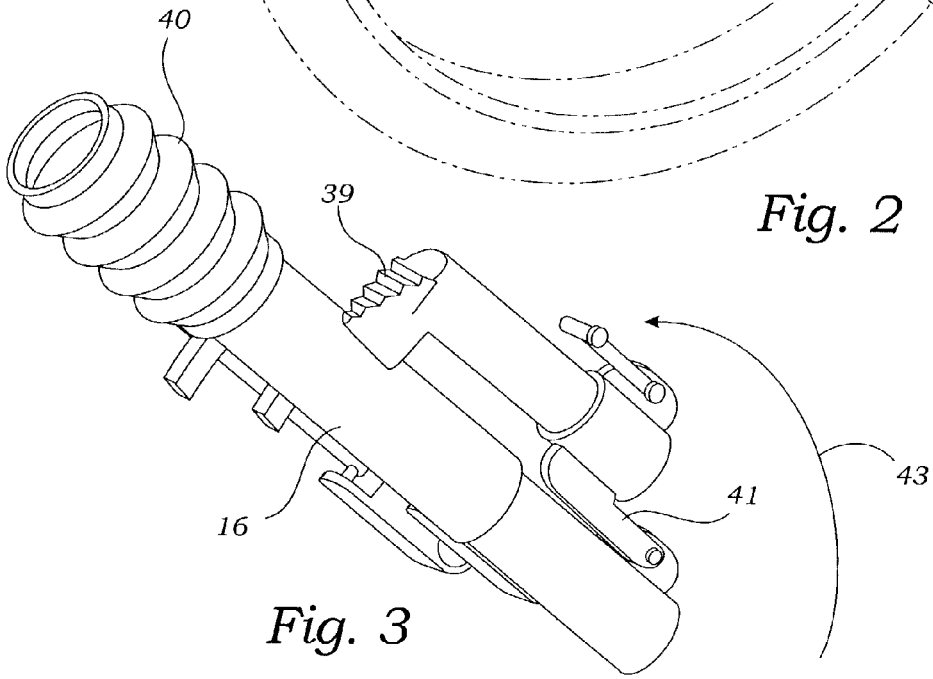
FIG. 3 is a further enlarged partial perspective view of the rear safety stop of the four-wheeled recreational assistance device of FIG. 1, in the raised or non-operating position.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an improved four-wheeled recreational assistance device designed as an exercise device for maintaining good health of persons with mobility, balance, leg, knee, or the like problems. The device of the present invention accommodates mature adults or other jogging or walking persons needing some support or assistance, for any reason. Mature adults are herein defined as those over 55 years of age.

Turning now to the drawings, there shown is an improved four-wheeled recreational assistance device of the present invention that is especially useful for mature adults or other persons during exercise, such as jogging or walking, or at any other time where a mature adult might feel the need for balance or security, such as when dizzy or tired, but feels the need to exercise or move about easily over rough terrain, with adequate support.

The four-wheeled recreational assistance device of the present invention differs from presently available jogging strollers and walkers or rollators in several respects. Some mature adults are well known for refusing to jog or walk because they fear the consequences of falling or slipping. Additionally, the known devices, such as walkers or rollators, tend to be expensive, clumsy or cumbersome, too complicated to use, do not look safe and are not aesthetically pleasing. Moreover, many mature adults do not wish to be seen in front of other people using known walkers or rollators that look like medical devices. Furthermore, known walkers or rollators are not designed to be used in inclement weather, or to jog, walk fast or over long distances, or for movement over rough terrain, such as on beaches, nature trails and the like.

The four-wheeled recreational assistance device of the present invention helps to overcome any adverse psychological phenomenon that might be associated with using a walker or rollator. That is, it has been found that mature adults enjoy using the four-wheeled recreational assistance device of the present invention, since it is bright, colorful, modern and streamlined, without looking like a medical device, and allows them to more easily exercise, in any type of weather, and over any type of terrain so as to improve their health and quality of life.

The rejection of known walkers or rollators by some mature adults tends to render most such devices useless or infrequently used, therefore, depriving mature adults of the known benefits of exercise. Moreover, even those mature adults using known walkers or rollators cannot or do not use them to exercise, or in inclement weather, or to move in non-urban, unpaved areas, thereby forcing the user to stay away from desirable areas, such as nature trails, having rough terrain.

Prior art walkers or rollators are normally equipped with three or four single or sometimes 3 or 4 sets of two wheels each, which wheels are usually plastic. One or two sets of these wheels may be movable so as to be steering casters, while at least two sets are usually fixed. This type of walker or rollator is normally pushed with two hands and steered by exerting pressure on the handle bar to move the steering caster or casters in the desired direction. Additionally, such known walkers or rollators usually are difficult to maneuver, unless moving straight ahead at a slow speed.

The four-wheeled recreational assistance device of the present invention overcomes the above-identified problems and many others, too numerous to mention.

The structure of the present invention is specifically designed so as to be easy to use and have a streamlined, modern appearance that does not give the connotation or impression of a medical device. The device of the present invention is preferably made with an adjustable framework of strong tubular elements for strength and durability. The device of the present invention is also made to be collapsible for easy storage and includes a braking system. The device may also include a bag for carrying items and a safety belt or harness to prevent unwanted movement of the device should a person using it slip or fall. The device of the present invention also includes a light frame and back stops to prevent the device from falling over backwards and to rest in a stop position.

The present invention is a true exercise device and is preferably provided with large pneumatic wheels, and, particularly, lockable front casters or wheels and larger rear wheels to enable a user to jog or walk safely over rough terrain. The optional safety belt or harness is preferably tied into the braking system of the device to prevent further movement of the device if a person slips or falls while walking or jogging.

The drawings show a currently preferred embodiment of the recreational assistance device of the present invention, generally indicated at 10. This device 10 is constructed in accordance with the principles of the present invention to provide an uncomplicated easy to use device having a center of gravity to prevent tipping that separates it from known devices, such as jog strollers. The device has a main body or frame 12 having a front portion 14, and a rear portion 16 preferably secured together to have an included angle 18 therebetween of approximately 90°, with a center of gravity therebetween that prevents the body 12 from tipping.

The front portion 14 and rear portion 16 are preferably pivotably held together at joints or junctions 20, 22, to allow the front and rear to be folded together into a more compact form for storage and transportation.

The main body or frame 12 is preferably constructed as an open framework of tubular elements made from any strong material, such as structural plastics, steel, aluminum alloys, titanium, or the like to provide a lightweight, sleek, sturdy frame. Padding or cushioning 24, preferably thick to prevent injuries, may be selectively applied to any desired upper surface, such as 26, 28, 30, so as to provide a cushioned area to protect a person 31 using the device in case they hit or impact such surface, for any reason.

The joints or junctions 20, 22 preferably carry or support tubular elements 32, 34 having opposed ends of a crossbar 36 held therein. The tubular elements 32, 34 are shown in a lowered position, and are preferably adjustable; or the ends of the crossbar 36 may be adjustably held in the support elements 32, 34, in any desired manner, as for example, a pin selectively movable into holes or openings formed in one or more tubular elements to allow the height of the crossbar to be adjusted for the user. A bridge element or connecting portion 38 is mounted centrally on the crossbar 36 for supporting a pair of handlebars 28. The handlebars 28 may be any desired shape, such as bicycle handle bars.

Additionally, the opposed ends of the crossbar 36 may have bag carrying elements 35, such as retractable or telescoping poles, secured thereto to support a carrying bag 37 (shown in broken line in FIG. 1) to enable packages or other materials to be inserted and held in the carrying bag.

The rotatable front and rear portions 14, 16 preferably comprise a pair of legs that may be adjustable to allow the height of the device 10 to be customized to fit a user. Each pair of legs 14, 16 may include shock absorbers 40, 42 to reduce any vibrations when traveling across rough terrain. Lower ends of the legs 14, 16 comprise axle means to rotatably hold large wheels 44, 46, which large wheels are preferably pneumatic for easier and more comfortable travel over rough terrain. The large front wheels 44 are preferably smaller than the large rear wheels 46. In a currently preferred embodiment of the invention the large front wheels 44 are about 8.5 inches in diameter while the larger rear wheels 46 are about 12 inches in diameter. These large, preferably pneumatic wheels 44, 46 may be of any desired width to allow the device 10 to be more easily moved at any desired speed, for example while walking or jogging over any substantially any surface outdoors. The large size of the wheels 44, 46 also accommodates easy movement in urban settings, such as over street curbs and other uneven surfaces.

The two front legs 14 are preferably secured together by a brace 48 and include angled lower ends that have lockable swivel elements 50 holding the wheels 44. In the unlocked position, the swivel elements 50 allow the front wheels 44 to be easily maneuvered. However, the swivel elements are lockable, as by means of any type locking element, such as a rotatable or sliding lock, to prevent the front wheels 44 from swiveling when the device 10 is moving over rough terrain.

Figure 4:
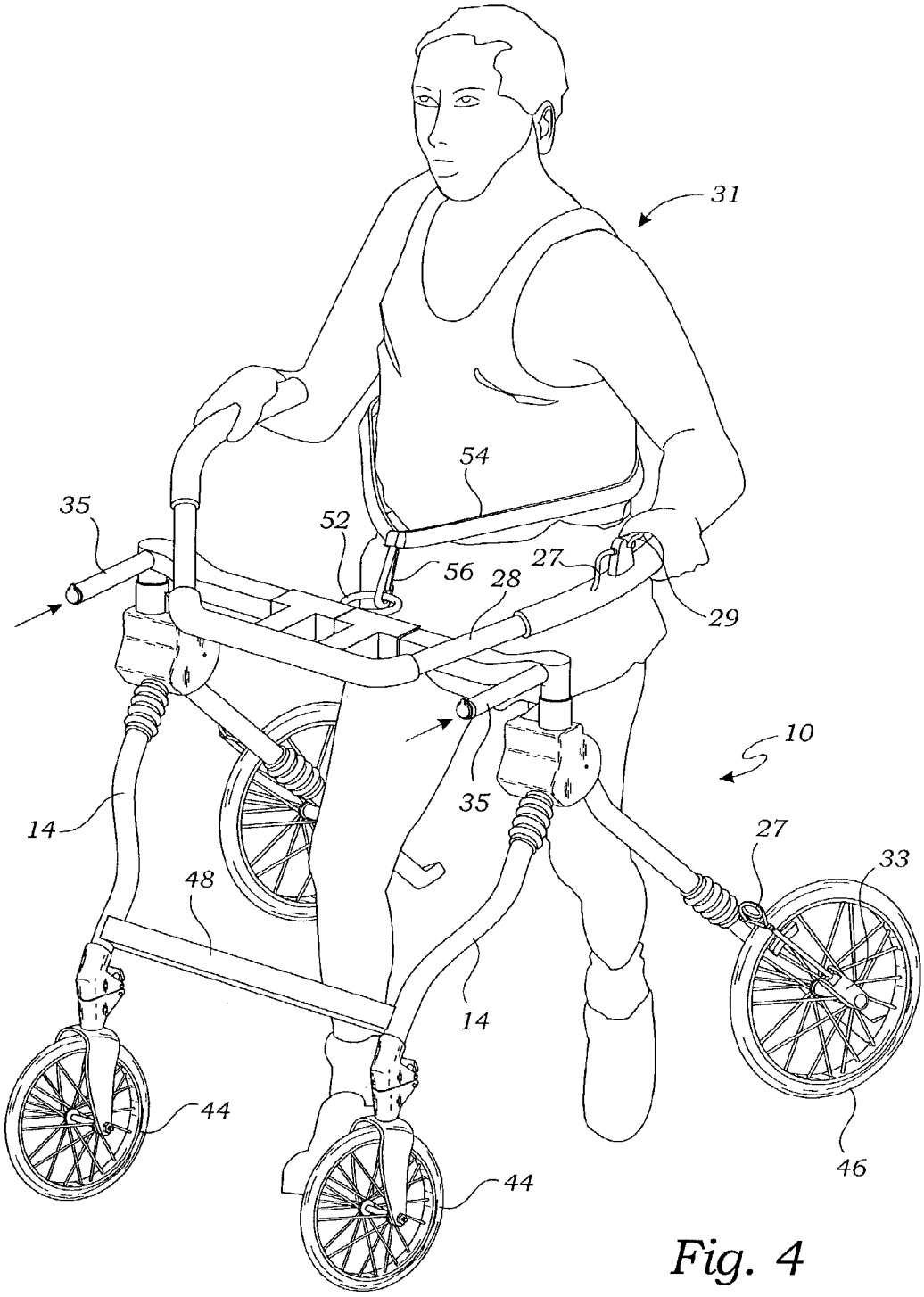
FIG. 4 is a further perspective view of an improved four-wheeled recreational assistance device of the present invention showing a person using the device while exercising and wearing an optional harness attached between the braking system of the device and the person.

The front wheels 44 are preferably more closely spaced together than the rear wheels to allow a person 31 to enter the open frame 12, between the rear wheels 46 and the handlebars 28 to use the device of the present invention, a shown in FIG. 4.

The handlebars 28 are preferably mounted on the bridge element or connecting portion 38 at an angle to the crossbar 36 to enable the user 31 to more easily grasp the ends thereof. Additionally, at least one end of the handlebars 28 is provided with a brake handle 29. The brake handle 29 is tied into a braking system having cables 27 connected to the brake handle(s) at one end, enclosed within the hollow handlebars 28, crossbar 36, tubular elements 32, 34 and rear legs 16, and exiting the rear legs where they are connected to brake elements 33 cooperating with the rear wheels 46.

Outer ends 39 of the rear legs 16 have lower ends or surfaces, preferably serrated or grooved that act as rear stoppers or back stops, to prevent the four-wheeled device 10 from tipping over during movement, or moving backwards when in the rest or stopped position. The lower ends 39 are mounted on or secured to a hinge mechanism 41 that allows the lower ends to be rotated in the direction of the arrow 43 to disengage the back stop feature, for example when traveling over rough terrain, to prevent accidental engagement of the back stop or stopping of the device 10 when moving.

As shown in FIGS. 1 and 4, the device 10 includes an anchoring eyelet or hook 52 that is connected to the braking system in any desired manner, for example, secured to the cable 27 in the hollow crossbar 36. A safety belt or harness 54 may be releasably secured to the eyelet 52, as by means of a securing element 56, such as a clip or the like. The safety belt or harness 54 may be then be secured to the user 31, for example around the user's waist, when the user is walking or jogging with the device 10. The belt or harness 54 will operate the brakes on the rear wheels 46 to prevent further movement of the device 10 if a person slips or falls while walking or jogging.

If desired, accessories or add-ons, such as a cup holder, pet leash, CD player, flashlight holder, reflectors, water bottle holder and the like (not shown) may be secured to the main body 12.

In a presently preferred embodiment of the present invention, the overall dimensions of the device 10 are as follows: the main body 12 is about 26 to 29 inches high, the front wheel 44 are about 12 inches apart, the rear wheels are about 25 to 26 inches apart, the cross-bar is between about 19 and 20 inches long, the handle bars are about 19 to 20 inches deep (U-shaped) and about 25 to 26 inches wide, and the distance between the center of the front wheels and the rear wheels is about 24 to 25 inches.

It can be seen that the four-wheeled recreational assistance device of the present invention, is easily entered from the rear between the rear wheels and the handle bars and the device easily pushed by a user grasping the handlebars because of the large wheels.

The present invention is designed to take advantage of today's advanced materials to make a sleek, modern looking exercise or recreational device that is both strong and light with excellent durability while being capable of being produced at a reasonable cost with a minimum of parts.

It can be seen that the four-wheeled recreational assistance device of the present invention is designed to overcome and eliminate many of the inherent shortcomings of the prior art devices, especially for mature adults wanting to exercise. More importantly, the device is safe for daily use and attractive to mature adults. It presents a considerable improvement in its convenience of use and in its maneuverability over all surfaces.

Thus, there has been described an improved and simplified four-wheeled recreational assistance device that is affordable, with an attractive modern, colorful and sleek appearance, which is both pleasing to the eye, and enables users to easily and safely exercise.

Those skilled in the art will appreciate the various adaptations and modifications of the just described preferred embodiments can be configured without departing from the scope and spirit of the invention. Therefore, it is to be understood that, within the scope of the appended claims, the invention may be practiced other than as specifically described herein.

What is claimed is:

1. A four-wheeled exercise device for adults, comprising:

a main body having a closed front portion and an open rear portion;

the closed front portion and the open rear portion having a pair of tubular legs rotatably held together at a pair of joints;

a pair of large front wheels rotatably secured to lower portions of the pair of tubular legs in the closed front portion and a pair of still larger rear wheels rotatably secured to lower portions of the pair of tubular legs in the open rear portion;

a crossbar secured to upper surfaces of the pair of joints;

a pair of handlebars secured to the crossbar; and a brake system including at least one handle mounted on the handlebars and a cable extending through hollow interior portions of the handlebars, the crossbar, and connected to brake elements cooperating with the pair of rear wheels.

2. The four-wheeled exercise device of claim 1, further including padding on a top surface of the crossbar and on the handlebars.

3. The four-wheeled exercise device of claim 2, further including lower ends on the pair of tubular legs in the open rear portion that act as back stops.

4. The four-wheeled exercise device of claim 3 wherein the lower ends are rotatably mounted on the pair of tubular legs in the open rear portion.

5. The four-wheeled exercise device of claim 4, further including a pair of telescoping arms mounted on the crossbar for supporting a bag.

6. The four-wheeled exercise device of claim 5, further including upstanding tubular sections secured to upper surfaces of the pair of joints and the crossbar being secured to the upstanding tubular sections.

7. The four-wheeled exercise device of claim 1, further including a harness for connection to the brake system, to aid in stopping the four-wheeled exercise device.

8. The four-wheeled exercise device of claim 7, further including lower ends rotatably mounted on the pair of tubular legs in the open rear portion, which lower ends are selectively moved to act as back stops.

9. The four-wheeled exercise device of claim 8, further including padding on a top surface of the crossbar and on the handlebars and a brace extending between the pair of tubular legs in the closed front portion.

10. The four-wheeled exercise device of claim 9, further including upstanding tubular sections secured to upper surfaces of the pair of joints and the crossbar being secured to the upstanding tubular sections.

11. The four-wheeled exercise device of claim 1, further including a pair of telescoping rods mounted on the crossbar for supporting a carrying bag.

12. The four-wheeled exercise device of claim 11, further including a harness for connection to the brake system, to aid in stopping the four-wheeled exercise device.

13. The four-wheeled exercise device of claim 12, further including lower ends rotatably mounted on the pair of tubular legs in the rear portion, which lower ends are selectively moved to act as back stops; padding secured on a top surface of the crossbar and on the handlebars; and upstanding tubular sections secured to upper surfaces of the pair of joints, with the crossbar being secured to the upstanding tubular sections.

14. A four-wheeled exercise device for adults, comprising:

an open main body having a front portion with a pair of tubular legs and a rear portion with a further pair of tubular legs;

the pair of tubular legs in the front portion and the pair of tubular legs in the rear portion rotatably held together at a pair of joints;

a pair of large pneumatic front wheels rotatably secured to lower portions of the pair of tubular legs in the front portion and a pair of still larger pneumatic rear wheels rotatably secured to lower portions of the pair of tubular legs in the rear portion;

the pair of tubular legs in the front portion being secured together by a brace;

upstanding tubular sections secured to upper surfaces of the pair of joints;

a crossbar secured to the upstanding tubular sections;

a pair of handlebars secured to the crossbar; and a brake system including at least one handle mounted on the handlebars and connected to an upper end of a cable extending through hollow interior portions of the handlebars, the upstanding tubular sections, the crossbar, and connected by lower ends to brake elements cooperating with the pair of rear wheels.

15. The four-wheeled exercise device of claim 14, further including a pair of telescoping rods mounted on the crossbar for supporting a carrying bag; a harness for connection to the brake system, to aid in stopping the four-wheeled exercise device; lower ends rotatably mounted on the pair of tubular legs in the rear portion, which lower ends are selectively moved to act as back stops; and padding mounted on a top surface of the crossbar and on the handlebars.

16. A four-wheeled exercise device for adults, comprising:

an open main body having a front portion with a pair of tubular legs and a rear portion with a further pair of tubular legs;

the pair of tubular legs in the front portion and the pair of tubular legs in the rear portion rotatably held together at a pair of joints;

a pair of large pneumatic front wheels rotatably secured to lower portions of the pair of tubular legs in the front portion and a pair of still larger pneumatic rear wheels rotatably secured to lower portions of the pair of tubular legs in the rear portion;

the pair of tubular legs in the front portion being secured together by a brace;

lower ends rotatably mounted on the pair of tubular legs in the rear portion, which lower ends are selectively moved to act as back stops;

upstanding tubular sections secured to upper surfaces of the pair of joints;

a crossbar secured to the upstanding tubular sections;

a pair of telescoping rods mounted on the crossbar for supporting a carrying bag;

a pair of handlebars secured to the crossbar;

a brake system including at least one handle mounted on the handlebars and connected to an upper end of a cable extending through hollow interior portions of the handlebars, the upstanding tubular sections, the crossbar, and connected by lower ends to brake elements cooperating with the pair of rear wheels;

a harness for connection to the brake system to aid in stopping the four-wheeled exercise device; and padding mounted on a top surface of the crossbar and on the handlebars.

* * * * *